US006379116B1

(12) United States Patent
Tai

(10) Patent No.: US 6,379,116 B1
(45) Date of Patent: Apr. 30, 2002

(54) IMPELLER AND STRUCTURE FOR AN IMPELLER HOUSING

(76) Inventor: Jen-Lung David Tai, 19507 N. 65th Ave., Glendale, AZ (US) 85308

( * ) Notice: Subject to any disclaimer, the term of this patent is extended or adjusted under 35 U.S.C. 154(b) by 0 days.

(21) Appl. No.: 09/669,249

(22) Filed: Sep. 25, 2000

(51) Int. Cl.[7] ..... F03B 3/12
(52) U.S. Cl. ..... 416/93 R; 416/210 R
(58) Field of Search ..... 415/199.5; 416/5, 416/210 R, 198 R, 175, 203, 93 R

(56) References Cited

U.S. PATENT DOCUMENTS 4,391,570 A * 7/1983 Stutzman ..... 416/93 R
4,838,760 A * 6/1989 Brackett ..... 416/93 R
5,489,191 A * 2/1996 Tai ..... 416/5
5,883,449 A * 3/1999 Mehta et al. ..... 416/5
5,944,487 A * 8/1999 Pearce ..... 416/5

* cited by examiner

*Primary Examiner*—Edward K. Look
*Assistant Examiner*—Igor Kershteyn
(74) *Attorney, Agent, or Firm*—Parsons & Goltry; Michael W. Goltry; Robert A. Parsons

(57) ABSTRACT

An impeller comprising a plurality of fan blades attached to a housing mounted for rotation and an electric motor contained in a chamber bound by the housing for rotating the housing, and a vent architecture of the housing comprising discrete groups of vents positioned along a substantially common plane, the first and second groups each for one of a) drawing air into the chamber and b) forcing air out of the chamber in response to rotation of the housing.

40 Claims, 4 Drawing Sheets

IMPELLER AND STRUCTURE FOR AN IMPELLER HOUSING

FIELD OF THE INVENTION

This invention relates to fans and to impellers and impeller housings.

BACKGROUND OF THE INVENTION

A typical ceiling fan consists of radial fan blades attached to a central hub that is driven to rotate by an electric motor. The assembly of blades and hub is known as an impeller, and the electric motor is normally contained in an impeller housing of the hub. The impeller housing rotates along with the attached fan blades and is normally equipped with vents, which allow air to circulate around the electric motor for keeping it cool. Although skilled artisans have devoted considerable effort toward improving the general structure and function of ceiling fans, relatively little effort has been devoted to the venting structure of impeller housings and to improving the air management around the electric motors of ceiling fans. Thus, there is a need for an impeller housing that includes a vent structure that greatly enhances the air management and forced air flow around the electric motor of a ceiling fan for keeping the electric motor cool during operation.

SUMMARY OF THE INVENTION

The above problems and others are at least partially solved and the above purposes and others realized in a new and impeller comprising a plurality of fan blades attached to a housing mounted for rotation and an electric motor contained in a chamber bound by the housing for rotating the housing. The housing includes a vent structure comprising first and second groups of vents positioned along a substantially common plane and each for one of a) drawing air into the chamber and b)forcing air out of the chamber in response to rotation of the housing. The first group comprises first substantially equally spaced-apart blades that define adjacent first openings, and the first blades are directed for one of a) drawing air into the chamber through the first openings and b) forcing air out of the chamber through the first openings in response to rotation of the housing. The second group comprises second substantially equally spaced-apart blades that define adjacent second openings, and the second blades are directed for the other of a) drawing air into the chamber through the second openings and b) forcing air out of the chamber through the second openings in response to rotation of the housing. The first blades are substantially parallel relative to one another and substantially radially disposed, and the second blades are substantially parallel relative to one another and substantially radially disposed.

BRIEF DESCRIPTION OF THE DRAWINGS

Referring to the drawings.

DETAILED DESCRIPTION OF A PREFERRED EMBODIMENT

Figure 1:
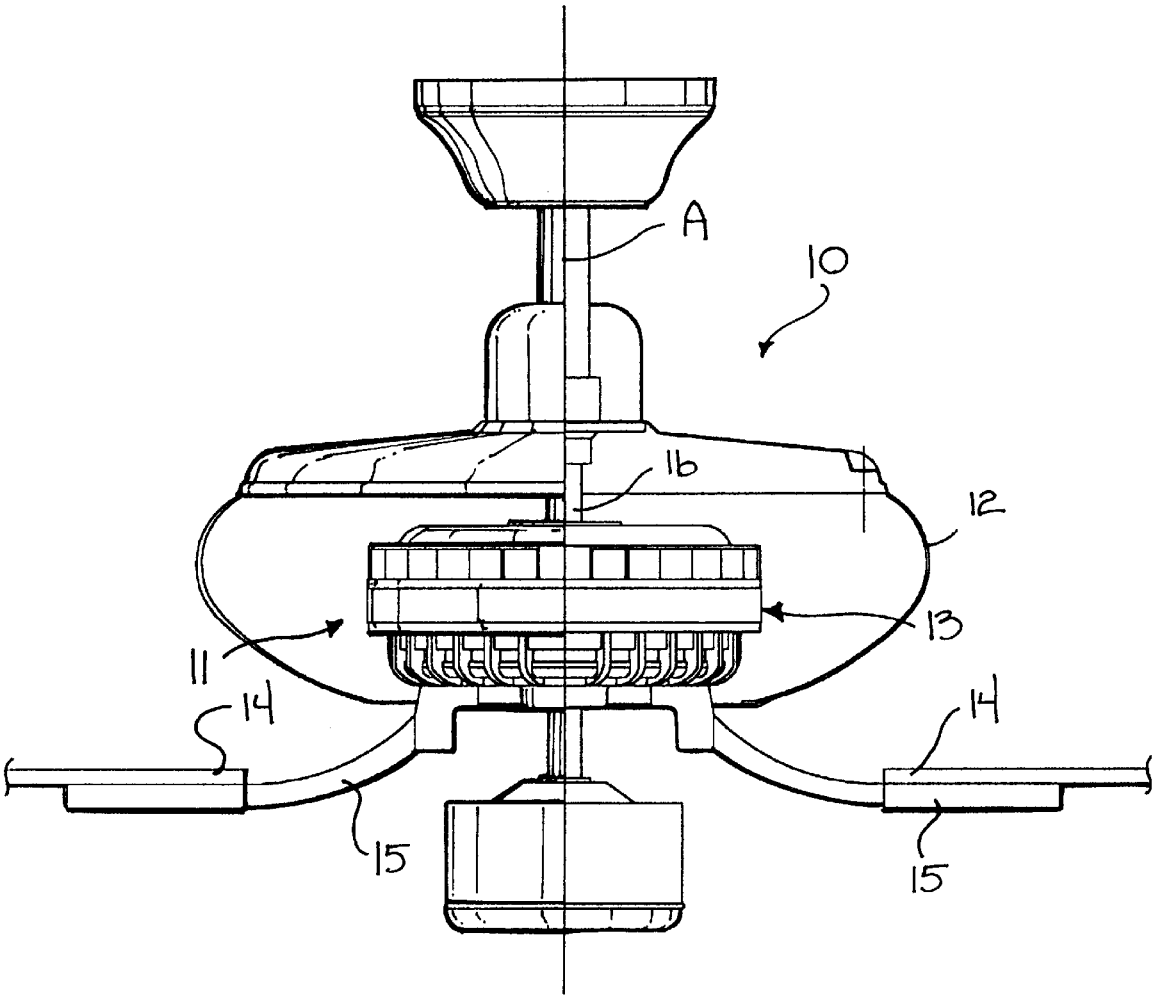
FIG. 1 is a schematic side view of a fan including an impeller constructed in accordance with the invention, the impeller including a plurality of fan blades attached to a housing.

Referring to the drawings, FIG. 1 is a schematic side view of a fan 10 including an impeller 11 constructed in accordance with the invention. The invention is useful with all types of fans, and is particularly useful in connection with ceiling fans. In this regard, fan 10 is a ceiling fan and impeller 11 is shown as it would appear partially held within a decorative housing 12 and suspended by and mounted to a shaft 16 for rotation along an axis A from a ceiling (not shown). Impeller 11 is comprised of a hub 13 having a plurality of attached fan blades 14 each for displacing air. Blade holders or brackets 15 attach fan blades 14 to hub 13 and screws, rivets or other suitable engagement apparatus connect blades 14 to brackets 15 and brackets 15 to hub 13 and, more particularly, to a housing 20 of hub 13.

Figure 4:
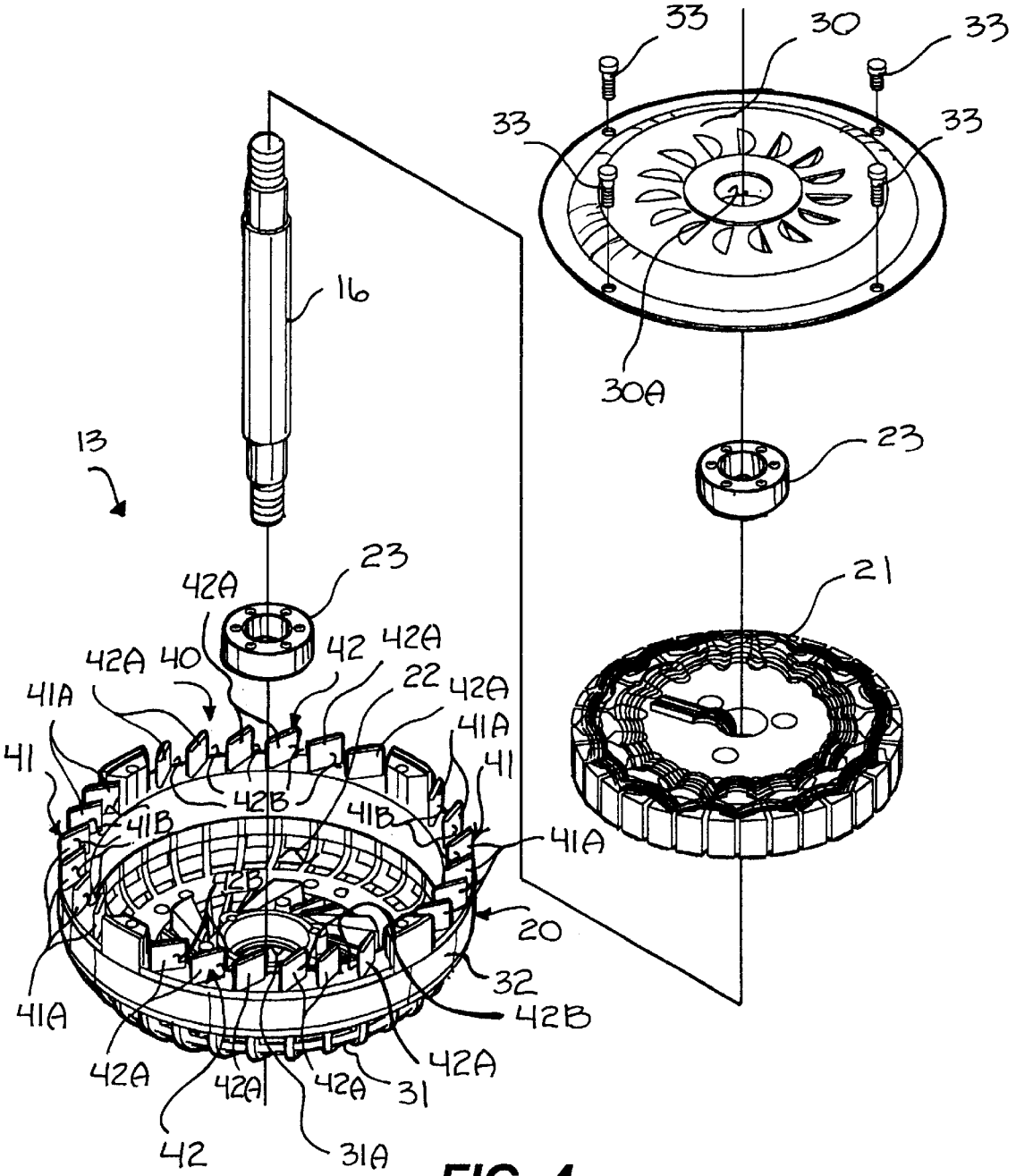
FIG. 4 is an exploded perspective view of the hub of FIG. 1.

FIG. 4 illustrates an exploded perspective view of hub 13. Hub 13 is comprised of housing 20 and a conventional electric motor 21. Motor 21 is operable for driving housing 20 for rotation and is contained within a chamber 22 bound by housing 20. Motor 21 and housing 20 encircle shaft 16 and are substantially axially aligned. As a matter of orientation, housing 20, motor 21 and shaft 16 are axially aligned along axis A of rotation (axis A is denoted only in FIG. 1). Motor 21 is fixed to shaft 16 and bearings 23 couple housing 20 to shaft 16 and allow it to rotate freely relative to shaft 16 and this is a conventional arrangement that is common to most ceiling fans. When motor 21 is energized with electrical power, it causes housing 20 and its attached fan blades (not shown in FIG. 4) to rotate and this is also a conventional arrangement. What is not conventional, however, is the geometry of housing 20 and, more particularly, its vent structure as will be described presently.

Figure 2:
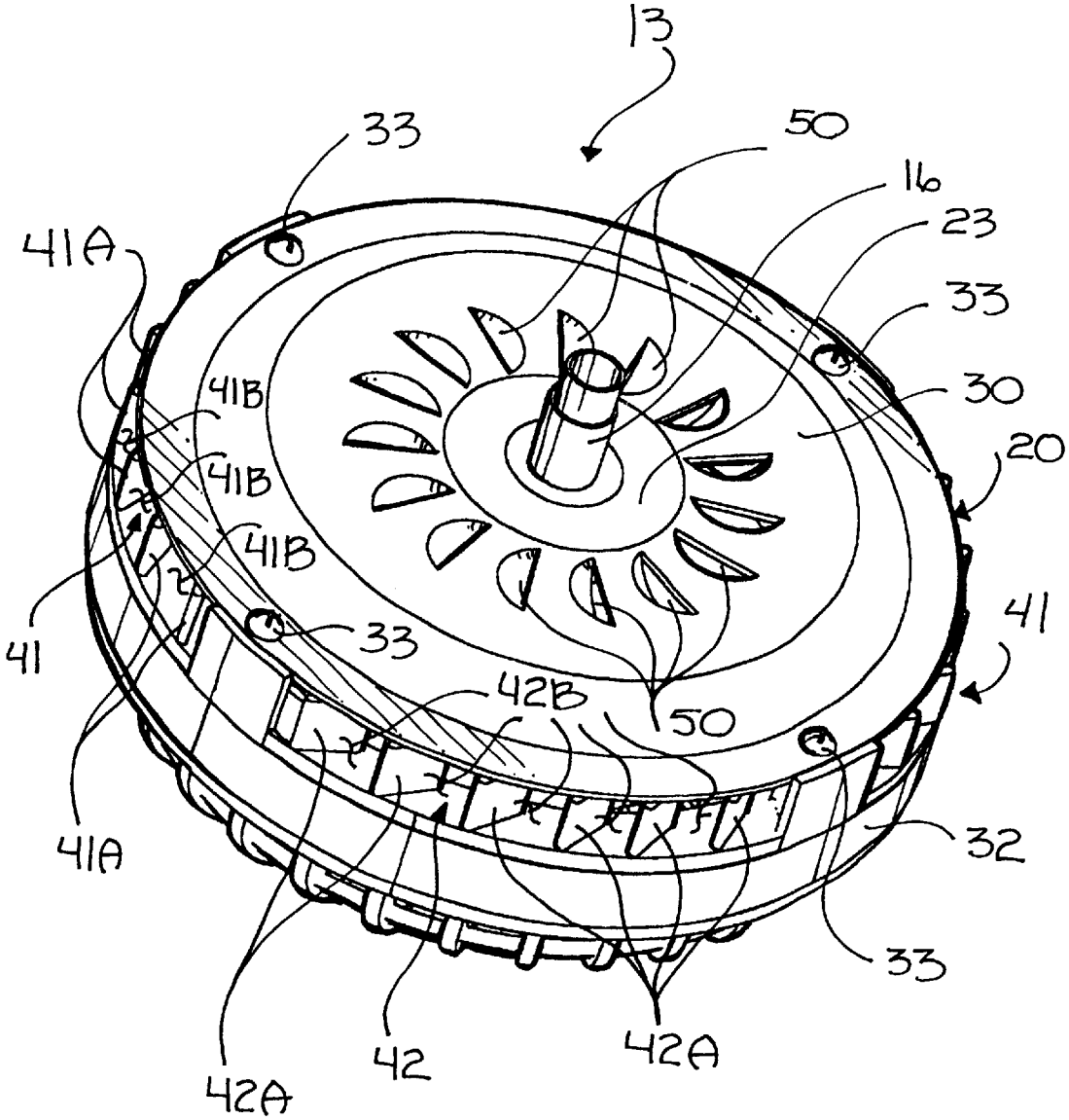
FIG. 2 is a top perspective view of the housing of FIG. 1.
Figure 3:
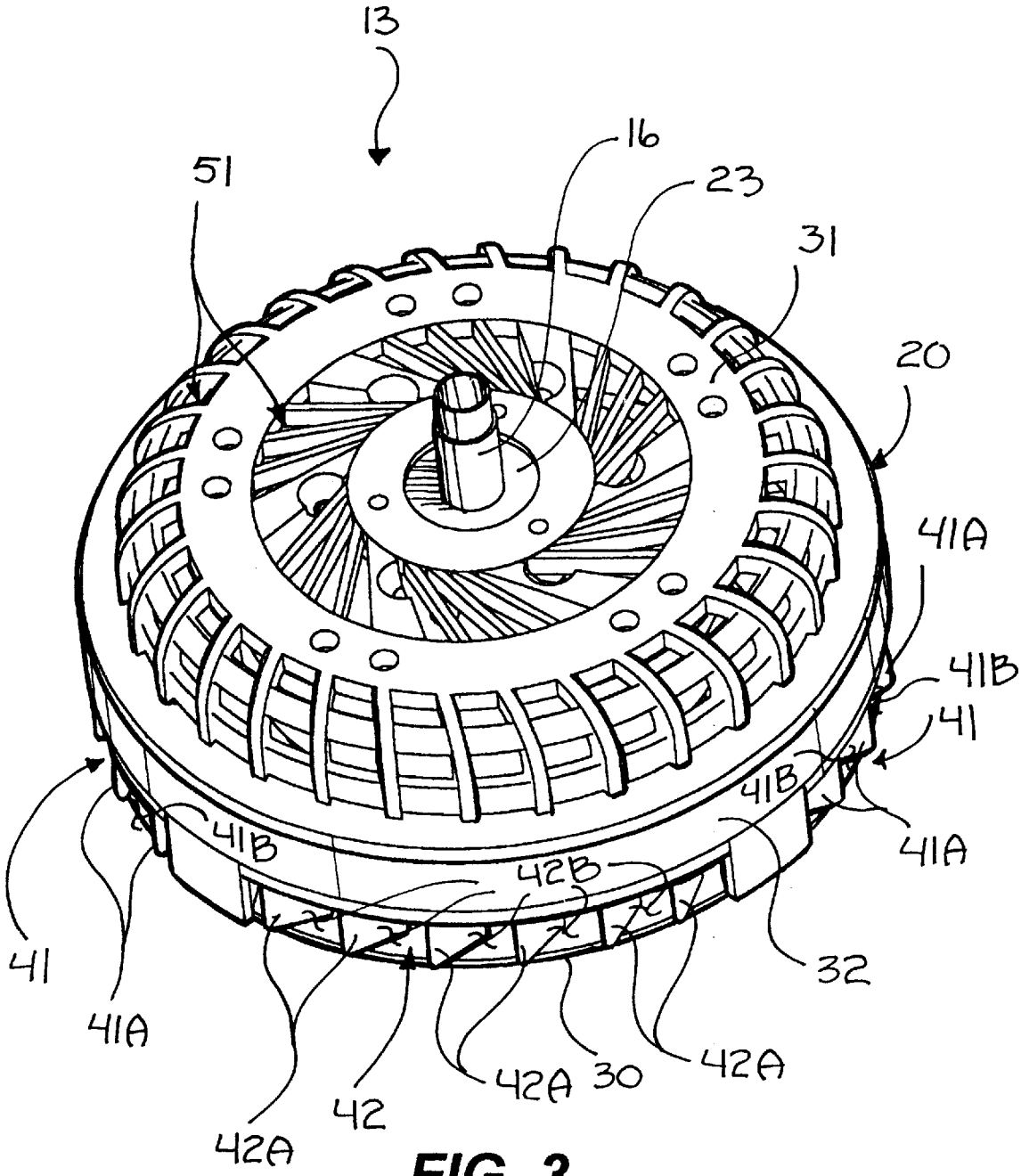
FIG. 3 is a bottom perspective view of the housing of FIG. 1.

With continuing reference to FIG. 4 and additional regard to FIGS. 2 and 3, housing 20 is comprised of opposing major faces 30 and 31 that meet at a continuous outer or distal extremity 32, which in this embodiment is substantially circular in shape. As best seen in FIG. 4, faces 30 and 31 include opposing central openings 30A and 31A, respectively. Bearings 23 are each fixed at one of openings 30A and 31A, and each bearing 23 may be constructed and arranged to rotate relative to shaft 16 or to allow housing 20 to rotate relative to it and preferably but not essentially the former. Faces 30 and 31 and extremity 32 together bound chamber 22 and housing 20 and its various components or structural features may be integrally formed or constructed as an assembly separate parts. In FIG. 4, face 30 is shown as a separate part that is engaged to extremity 32 with screws 33. In lieu of or in addition to screws 33, rivet, adhesive or other suitable engagement structure may be used including welding. Face 31 may be similarly constructed and arranged if so desired.

Housing 20 includes a vent structure 40 for drawing air into 22 chamber and for forcing air out of chamber 22 in response to rotation of housing 20 along axis A of rotation (FIG. 1). Regarding FIG. 4, structure 40 is located at extremity 32 and is comprised of alternating radial groups 41 and 42 of vents that are positioned along a substantially common plane, which is substantially perpendicular to axis A of rotation. Structure 40 is substantially continuous and common with extremity 32. The vents of groups 41 each comprise substantially equally spaced-apart blades 41A that define adjacent openings 41B, and the vents of groups 42 each comprise substantially equally spaced-apart blades 42A that define adjacent openings 42B. Groups 41 oppose one another and groups 42 oppose one another. Although two of each of groups 41 and groups 42 are illustrated, less or more of each can be employed. As seen in FIG. 4 and generally in FIGS. 2 and 3, blades 41A and 42A of adjacent groups 41 and 42, respectively, are pointed or otherwise directed in opposing directions. As a result of this structural arrangement and in response to rotation of housing 20 in the clockwise direction about axis A of rotation, groups 42 each function to scoop up and draw or otherwise force air into chamber 22 through openings 42B, and groups 41 each function to scoop up and draw or otherwise force air out of chamber 22 through 41B. This can be reversed by reversing the structure of groups 41 and 42 or simply by rotating housing 20 in the counterclockwise direction about axis A of rotation. In this regard, motor 21 may be constructed and arranged with the capability of rotating housing 20 in the clockwise and counterclockwise directions and this is a common feature among most ceiling fan motors.

Because groups 41 and 42 of vents reside in a substantially common plane, the transfer of air to and from chamber 22 is extremely efficient and produces a forceful and highly aggressive flow of air throughout chamber 22, which air flow provides an aggressive and highly efficient cooling of motor 21. With groups 41 and 42 in a substantially common plane, the flow of air into and from chamber 22 also takes place along a substantially common plane at extremity 32. This is very important, because it prevents the air flow from having to enter and leave chamber 22 at different planes at extremity 32, which can otherwise slow or impede the air flow into and from chamber 22 at extremity 32 and produce opposing turbulated flows that cancel each other out within chamber 22 proximate extremity 32. Furthermore, extremity 32 is the furthest structure of housing 20 from axis A of rotation. As a result, the speed of rotation of housing 20 is the greatest at extremity 32. Because structure 40 is located at or otherwise proximately extremity 32, its construction allows it to provide a very efficient and highly aggressive management of air transfer to and from chamber 22 for providing a maximum cooling effect for motor 21.

The invention has been described above with reference to one or more preferred embodiments. However, those skilled in the art will recognize that changes and modifications may be made in the described embodiments without departing from the nature and scope of the invention. For instance, faces 30 and 31 may be equipped with vents for, in response to rotation of housing 20, at least one of drawing air into chamber 22 and forcing air from chamber 22 and both if desired. In this regard, FIGS. 2 and 4 show face 30 equipped with radial vents 50 and FIG. 3 shows face 31 equipped with groupings of radial vents designated generally with the reference numeral 51. Any desired arrangement of vents may be employed in connection with faces 30 and 31.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. An impeller comprising:

a plurality of fan blades attached to a housing mounted for rotation and an electric motor contained in a chamber bound by the housing for rotating the housing; and a vent structure of the housing comprising first and second groups of vents positioned along a substantially common plane and each for one of a) drawing air into the chamber and b) forcing air out of the chamber in response to rotation of the housing.

2. The impeller of claim 1, wherein the first group comprises first substantially equally spaced-apart blades that define adjacent first openings, wherein first blades are directed for one of a) drawing air into the chamber through the first openings and b) forcing air out of the chamber through the first openings in response to rotation of the housing.

3. The impeller of claim 2, wherein the second group comprises second substantially equally spaced-apart blades that define adjacent second openings, wherein second blades are directed for the other of a)drawing air into the chamber through the second openings and b)forcing air out of the chamber through the second openings in response to rotation of the housing.

4. The impeller of claim 2, wherein the first blades are substantially parallel relative to one another.

5. The impeller of claim 3, wherein the second blades are substantially parallel relative to one another.

6. The impeller of claim 2, wherein the first blades are substantially radially disposed.

7. The impeller of claim 3, wherein the second blades are substantially radially disposed.

8. An impeller comprising:

a plurality of fan blades attached to a housing mounted for rotation and an electric motor contained in a chamber bound by the housing for rotating the housing; and a substantially continuous vent structure of the housing comprising alternating radial groups of vents positioned along a substantially common plane, each one of the groups for one of a) drawing air into the chamber and b) forcing air out of the chamber in response to rotation of the housing.

9. The impeller of claim 8, wherein ones of the groups each comprise first substantially equally spaced-apart blades that define adjacent first openings, wherein first blades are directed for one of a) drawing air into the chamber through the first openings and b) forcing air out of the chamber through the first openings in response to rotation of the housing.

10. The impeller of claim 9, wherein other ones of the groups each comprise second substantially equally spaced-apart blades that define adjacent second openings, wherein second blades are directed for the other of a) drawing air into the chamber through the second openings and b) forcing air out of the chamber through the second openings in response to rotation of the housing.

11. The impeller of claim 9, wherein the first blades of each of the ones of the groups are substantially parallel relative to one another.

12. The impeller of claim 10, wherein the second blades of each of the other ones of the groups are substantially parallel relative to one another.

13. In a housing engagable for rotation, for containing an electric motor for rotating the housing, and for supporting radial fan blades, a vent structure of the housing comprising first and second groups of vents positioned along a substantially common plane and each for one of a) drawing air into the chamber and b) forcing air out of the chamber in response to rotation of the housing.

14. The vent structure of claim 13, wherein the first group comprises first substantially equally spaced-apart blades that define adjacent first openings, wherein first blades are directed for one of a) drawing air into the chamber through the first openings and b) forcing air out of the chamber through the first openings in response to rotation of the housing.

15. The vent structure of claim 14, wherein the second group comprises second substantially equally spaced-apart blades that define adjacent second openings, wherein second blades are directed for the other of a) drawing air into the chamber through the second openings and b) forcing air out of the chamber through the second openings in response to rotation of the housing.

16. The vent structure of claim 14, wherein the first blades are substantially parallel relative to one another.

17. The vent structure of claim 15, wherein the second blades are substantially parallel relative to one another.

18. The vent structure of claim 14, wherein the first blades are substantially radially disposed.

19. The vent structure of claim 15, wherein the second blades are substantially radially disposed.

20. In a housing engagable for rotation, for containing an electric motor for rotating the housing, and for supporting radial fan blades, a substantially continuous vent structure of the housing comprising alternating radial groups of vents positioned along a substantially common plane, each one of the groups for one of a) drawing air into the chamber and b) forcing air out of the chamber in response to rotation of the housing.

21. The vent structure of claim 20, wherein ones of the groups each comprise first substantially equally spaced-apart blades that define adjacent first openings, wherein first blades are directed for one of a) drawing air into the chamber through the first openings and b) forcing air out of the chamber through the first openings in response to rotation of the housing.

22. The vent structure of claim 21, wherein other ones of the groups each comprise second substantially equally spaced-apart blades that define adjacent second openings, wherein second blades are directed for the other of a) drawing air into the chamber through the second openings and b) forcing air out of the chamber through the second openings in response to rotation of the housing.

23. The vent structure of claim 21, wherein the first blades of each of the ones of the groups are substantially parallel relative to one another.

24. The vent structure of claim 22, wherein the second blades of each of the other ones of the groups are substantially parallel relative to one another.

25. An impeller housing comprising:

a chamber bound by opposing faces that meet at a continuous extremity; and a vent structure located proximate the continuous extremity comprising first and second groups of vents positioned along a substantially common plane and each for one of a) drawing air into the chamber and b) forcing air out of the chamber in response to rotation of the housing along an axis of rotation.

26. The impeller housing of claim 25, wherein the first group comprises first substantially equally spaced-apart blades that define adjacent first openings, wherein first blades are directed for one of a) drawing air into the chamber through the first openings and b) forcing air out of the chamber through the first openings in response to rotation of the housing.

27. The impeller housing of claim 26, wherein the second group comprises second substantially equally spaced-apart blades that define adjacent second openings, wherein second blades are directed for the other of a) drawing air into the chamber through the second openings and b) forcing air out of the chamber through the second openings in response to rotation of the housing.

28. The impeller housing of claim 26, wherein the first blades are substantially parallel relative to one another.

29. The impeller housing of claim 27, wherein the second blades are substantially parallel relative to one another.

30. The impeller housing of claim 26, wherein the first blades are substantially radially disposed.

31. The impeller housing of claim 27, wherein the second blades are substantially radially disposed.

32. The impeller housing of claim 25, wherein the plane is substantially perpendicular to the axis of rotation.

33. A ceiling fan constructed with the impeller housing of claim 25.

34. An impeller housing comprising:

a chamber bound by opposing faces that meet at a continuous extremity; and a vent structure located proximate the continuous extremity comprising a substantially continuous arrangement of alternating groups of vents positioned along a substantially common plane, each one of the groups for one of a) drawing air into the chamber and b) forcing air out of the chamber in response to rotation of the housing.

35. The impeller housing of claim 34, wherein ones of the groups each comprise first substantially equally spaced-apart blades that define adjacent first openings, wherein first blades are directed for one of a) drawing air into the chamber through the first openings and b) forcing air out of the chamber through the first openings in response to rotation of the housing.

36. The impeller housing of claim 35, wherein other ones of the groups each comprise second substantially equally spaced-apart blades that define adjacent second openings, wherein second blades are directed for the other of a) drawing air into the chamber through the second openings and b) forcing air out of the chamber through the second openings in response to rotation of the housing.

37. The impeller housing of claim 35, wherein the first blades of each of the ones of the groups are substantially parallel relative to one another.

38. The impeller housing of claim 36, wherein the second blades of each of the other ones of the groups are substantially parallel relative to one another.

39. The impeller housing of claim 34, wherein the plane is substantially perpendicular to the axis of rotation.

40. A ceiling fan constructed with the impeller housing of claim 34.

* * * * *

UNITED STATES PATENT AND TRADEMARK OFFICE
Certificate

Patent No. 6,379,116 B1 Patented: April 30, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Cliff Wang, Taichung (TW).

Signed and Sealed this Twenty-eighth Day of July 2009.

EDWARD LOOK
*Supervisory Patent Examiner*
Art Unit 3745